US006819198B2

(12) United States Patent
Okada et al.

(10) Patent No.: US 6,819,198 B2
(45) Date of Patent: Nov. 16, 2004

(54) NONRECIPROCAL CIRCUIT DEVICE AND HIGH-FREQUENCY CIRCUIT APPARATUS

(75) Inventors: Takekazu Okada, Ishikawa-ken (JP); Satoru Shinmura, Kanazawa (JP); Toshihiro Makino, Matto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/792,573

(22) Filed: Feb. 23, 2001

(65) Prior Publication Data

US 2001/0030584 A1 Oct. 18, 2001

(30) Foreign Application Priority Data

Feb. 25, 2000 (JP) ..... 2000-049281

(51) Int. Cl.[7] ..... H01P 1/36
(52) U.S. Cl. ..... 333/24.2; 333/1.1
(58) Field of Search ..... 333/1.1, 24.2; H01P 1/36

(56) References Cited

U.S. PATENT DOCUMENTS

| | | | | | |
|---|---|---|---|---|---|
| 3,286,201 | A | * | 11/1966 | Roberts, Jr. | 333/1.1 |
| 3,621,477 | A | * | 11/1971 | Bosma | 333/1.1 |
| 3,739,302 | A | * | 6/1973 | McManus | 333/1.1 |
| 3,820,041 | A | | 6/1974 | Gewartowski et al. | 333/1.1 |
| 3,836,874 | A | | 9/1974 | Maeda et al. | 333/1.1 |
| 4,016,510 | A | | 4/1977 | Hodges, III et al. | 333/1.1 |
| 4,210,886 | A | * | 7/1980 | Enderby et al. | 333/24.2 |
| RE31,704 | E | * | 10/1984 | Hester | 361/752 |
| 4,631,504 | A | * | 12/1986 | Matsuda et al. | 333/25 |
| 5,923,224 | A | | 7/1999 | Makino et al. | 333/1.1 |
| 5,945,887 | A | * | 8/1999 | Makino et al. | 333/1.1 |

FOREIGN PATENT DOCUMENTS

| | | | | | |
|---|---|---|---|---|---|
| DE | 100 65 511 | A1 | | 7/2001 | |
| EP | 0779673 | | | 6/1997 | |
| EP | 0 843 375 | A1 | | 5/1998 | |
| EP | 0903801 | A | * | 3/1999 | H01P/1/387 |
| FR | 2671912 | | | 7/1992 | |
| JP | 41-011290 | | | 6/1966 | |
| JP | 5624815 | | | 3/1981 | |
| JP | 583402 | | | 6/1981 | |
| JP | 57-181202 | A | | 11/1982 | |
| JP | 4-172702 | A | | 6/1992 | |
| JP | 7-283616 | A | | 10/1995 | |
| JP | 08008612 | | | 1/1996 | |
| JP | 09328418 | | | 9/1997 | |
| JP | 10-284907 | A | | 10/1998 | |
| JP | 11-205016 | A | | 7/1999 | |
| JP | 11308013 | A | * | 11/1999 | H01P/1/383 |

OTHER PUBLICATIONS

Tech Briefs, Use of Ferrimagnetic Material in Circulators, Oct. /1966, Trans Tech, Inc., p. 39, No. 6511 Microwave Ferrite Applications.*

W. Golombek; "Circulators and isolators for reducing transmitter intermodulation"; Electronic Components & Applications; vol. 5, No. 3; Jun. 1983; pp. 154–158; XP–002226893; Phillips. Eindhoven, NL.

* cited by examiner

*Primary Examiner*—Stephen E. Jones
(74) *Attorney, Agent, or Firm*—Keating & Bennett, LLP

(57) ABSTRACT

A nonreciprocal circuit device includes a first center electrode and a second center electrode intersecting each other, each having one end thereof grounded, a ferrimagnetic body provided in the vicinity of the first center electrode and the second center electrode, a magnet applying a magnetostatic field to the ferrimagnetic body, a series capacitor connected in series between the other end of the first center electrode and an input terminal and a series capacitor connected in series between the other end of the second center electrode and an output terminal, and a parallel capacitor connected in parallel between the other end of the first center electrode and a ground and a parallel capacitor connected in parallel between the other end of the second center electrode and the ground.

28 Claims, 8 Drawing Sheets

PHASE DIFFERENCE 0° AT BOTH ENDS OF THE RESISTOR R

PHASE DIFFERENCE 180° AT BOTH ENDS OF THE RESISTOR R

NONRECIPROCAL CIRCUIT DEVICE AND HIGH-FREQUENCY CIRCUIT APPARATUS

BACKGROUND OF THE INVENTION

1. Field of the Invention

The present invention relates to a nonreciprocal circuit device such as an isolator used in a microwave band or the like and relates to a high-frequency circuit apparatus such as a communication apparatus provided therewith.

2. Description of the Related Art

Nonreciprocal circuit devices used in a microwave band or the like are disclosed in (1) U.S. Pat. No. 4,016,510, (2) Japanese Unexamined Patent Application Publication No. 52-134349, (3) Japanese Unexamined Patent Application Publication No. 58-3402, (4) Japanese Unexamined Patent Application Publication No. 9-232818, and (5) Japanese Unexamined Patent Application Publication No. 8 8612.

The above nonreciprocal circuit device is a component in which a ferrite plate is provided with center electrodes intersecting at a predetermined angle and then a static magnetic field is applied to the ferrite plate. By making use of a ferrimagnetic characteristic of the ferrite plate, the plane of polarization or a high frequency magnetic field caused by the center electrodes is rotated in accordance with Faraday's law of rotation. This produces a nonreciprocal characteristic.

In the nonreciprocal circuit device such as the one in (5)-above that uses first to third center electrodes, the matching impedance of the third center electrode has a reactance component. Since the impedance depends on the frequency, the frequency range in which a preferable nonreciprocal characteristic can be obtained is narrow. That is, when the component is used as an isolator, the isolation characteristic inevitably has a narrow band.

The nonreciprocal circuit device that used two center electrodes has advantages of miniaturization and realization of a broader band. Further miniaturization of the nonreciprocal circuit device such as the isolator used in a communication apparatus has been also required in accordance with recent demands to miniaturize the communication apparatus in a wireless communication system.

However, when the size of a ferrite plate is greatly miniaturized to, for example, 0.5 mm×0.5 mm×0.3 mm while the conventional construction of the nonreciprocal component is maintained, as described below, since the length of the center electrode is shortened, the inductance component thereof is decreased. When the nonreciprocal circuit device is operated at a predetermined frequency, impedance matching cannot be obtained. Accordingly, the problem of increased insertion loss (IL) arises.

The circuit diagram of the conventional isolator is as shown in FIG. 8. When the inductance of center electrodes L1 and L2 impedance-match the capacitances of parallel capacitors C1 and C2, the impedance locus is the relationship as shown in FIG. 9. That is, when the impedance of the center electrode is a predetermined value, the impedance of the center electrode must be on a susceptance circle passing through 50 Ω in order to connect the parallel capacitors so as to match the normalized impedance (50 Ω).

However, when the size of the isolator is desired to be approximately 3.5 mm×3.5 mm×1.5 mm or below, the size of the ferrite plate is 1.0 mm×1.0 mm×0.3 mm or below in a case in which it is a rectangular parallelepiped. In a construction such as that of the conventional isolator in which the center electrode is provided on only a principal-surface side of the ferrite plate, the inductance of the center electrode is decreased. Therefore, since the reactance is small at the operating frequency, the capacitances of the matching parallel capacitors must be increased. However, because of this, there arises a problem in that the operating frequency bandwidth is narrowed.

Furthermore, when a single-plate capacitor is used as the above matching parallel capacitors, the size thereof increases, which does not allow an isolator of a target size to be realized. For example, when it is intended to design an isolator with external dimensions of 3.5 mm square having an 800 MHz band, the capacitance of the parallel capacitor is required to be 6 pF for an inductance of the center electrode of 6.6 nH. Even though a high dielectric constant ceramic plate with a relative dielectric constant or, for example, 110 is used to form the matching parallel capacitors with a thickness of as thin as 0.17 mm, the dimensions of the capacitor are increased to as large as approximately 1.0 mm×1.05 mm, which means that the capacitor cannot be contained in the isolator of the target size.

Overall miniaturization decreases the size or the center electrode, which decreases the inductance of the center electrode. When the inductance is too small to be on the susceptance circle passing through the normalized impedance (50 Ω), impedance matching cannot be obtained regardless of increased capacitance of the parallel capacitors. This increases the input/output impedances and worsens the insertion loss.

SUMMARY OF THE INVENTION

Objects of this invention are to provide a small nonreciprocal circuit device which exhibits a nonreciprocal characteristic over a wide band and which has low insertion loss and to provide a high-frequency circuit apparatus, such as a communication apparatus, using the nonreciprocal circuit device.

To this end, according to a first aspect of the present invention, there is provided a nonreciprocal circuit device including a first center electrode and a second center electrode intersecting each other, each having one end thereof grounded, a ferrimagnetic body provided in the vicinity of the first center electrode and the second center electrode, a magnet applying a magnetostatic field to the ferrimagnetic body, a series capacitor connected in series between the other end of the first center electrode and an input terminal and a series capacitor connected in series between the other end of the second center electrode and an output terminal, and a parallel capacitor connected in parallel between the other end of the first center electrode and a ground and a parallel capacitor connected in parallel between the other end of the second center electrode and the ground.

Since use of series capacitors and parallel capacitors enable input/output impedance to be positively matched, more insertion loss can be reduced, whereby miniaturization and a widened band can be achieved.

In the nonreciprocal circuit device, the first center electrode and the second center electrode may be wrapped around the ferrimagnetic body.

This enables the sufficient amount of inductance of the first and second center electrodes to be obtained even though a small ferrimagnetic body is used. Therefore, overall miniaturization can be achieved.

In the nonreciprocal circuit device, the intersection angle of the first center electrode and the second center electrode may be a predetermined angle in the range of 80 degrees to 100 degrees.

This enables low insertion loss and high non-reciprocal characteristic to be obtained.

In the nonreciprocal circuit device, the ferrimagnetic body may be polygonal plate.

This enables the magnetic coupling distance between the first and second center electrodes with respect to the ferrimagnetic body of the first and second center electrodes to be gained to be long. In addition, when the first and second center electrodes are wrapped around the ferrimagnetic body, wrapping is facilitated. Furthermore, even though the ferrimagnetic body is small, low insertion loss and high non-reciprocal characteristic can be obtained.

In the nonreciprocal circuit device, the magnet may be a rectangular parallelepiped.

This enables the intensity of the magnetostatic field applied to the ferrimagnetic body to be more increased in a limited volume in the nonreciprocal circuit device having an overall rectangular parallelepiped shape. Accordingly, low insertion loss and high non-reciprocal characteristic can be obtained. Furthermore, since the nonreciprocal circuit device can be constructed by cutting from a plate-like or rectangular parallelepiped magnetic material, manufacturing is facilitated.

Alternatively, in the nonreciprocal circuit device, the first center electrode, the second center electrode, the ferrimagnetic body, and the magnet are provided between an upper yoke and a lower yoke, and the upper yoke and the lower yoke are grounded.

Since the first and second center electrodes and the capacitors are grounded along with the yokes to be shielded, occurrence of spurious can be prevented.

According to a second aspect of the present invention, a high-frequency circuit apparatus includes one of the above-described nonreciprocal circuit devices.

This enables a communication apparatus having low insertion loss and stability in the characteristics to be obtained.

DESCRIPTION OF THE PREFERRED EMBODIMENTS

The construction of an isolator according to a first embodiment of the present invention is described with reference to FIGS. 1 to 3.

Figure 1:
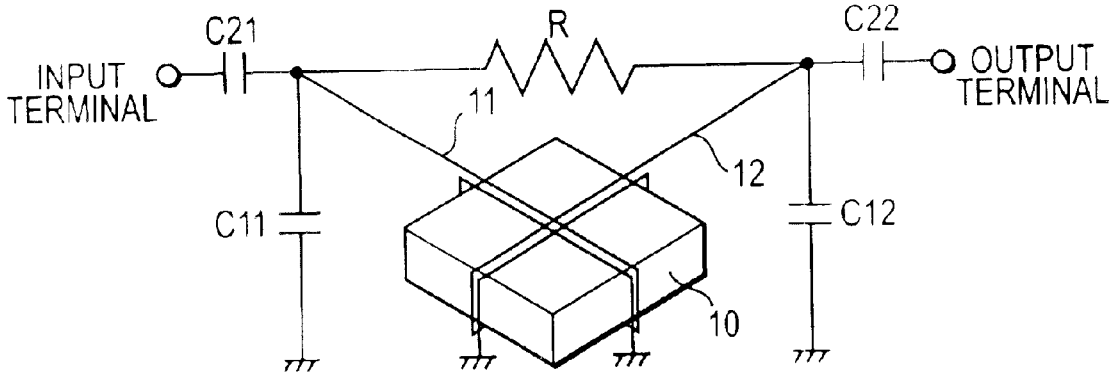
FIG. 1 is a circuit diagram of an isolator according to a first embodiment.

FIG. 1 is a circuit diagram of the isolator. Here, a ferrite plate 10 is a rectangular parallelepiped. A first center electrode 11 and a second center electrode 12 which each include a copper wire coated with insulator are wrapped around the ferrite plate 10 so as to intersect each other at a predetermined angle. One end of each of the first and second center electrodes 11 and 12 is grounded. Series capacitors C21 and C22 are connected in series between the other end of the first center electrode 11 and an input terminal and between the other end of the second center electrode 12 and an output terminal, respectively. Parallel capacitors C11 and C12 are connected in parallel between the other end of the first center electrode 11 and the ground and between the other end of the second center electrode 12 and the ground, respectively. In addition, a resistor R is connected between the other ends of the first center electrode 11 and the second center electrode 12. Although not shown in this figure, a magnet is provided for applying a magnetostatic field to the ferrite plate 10 in the thickness direction (the direction parallel to loop planes that the first center electrode 11 and the second center electrode 12 define).

Figure 2:
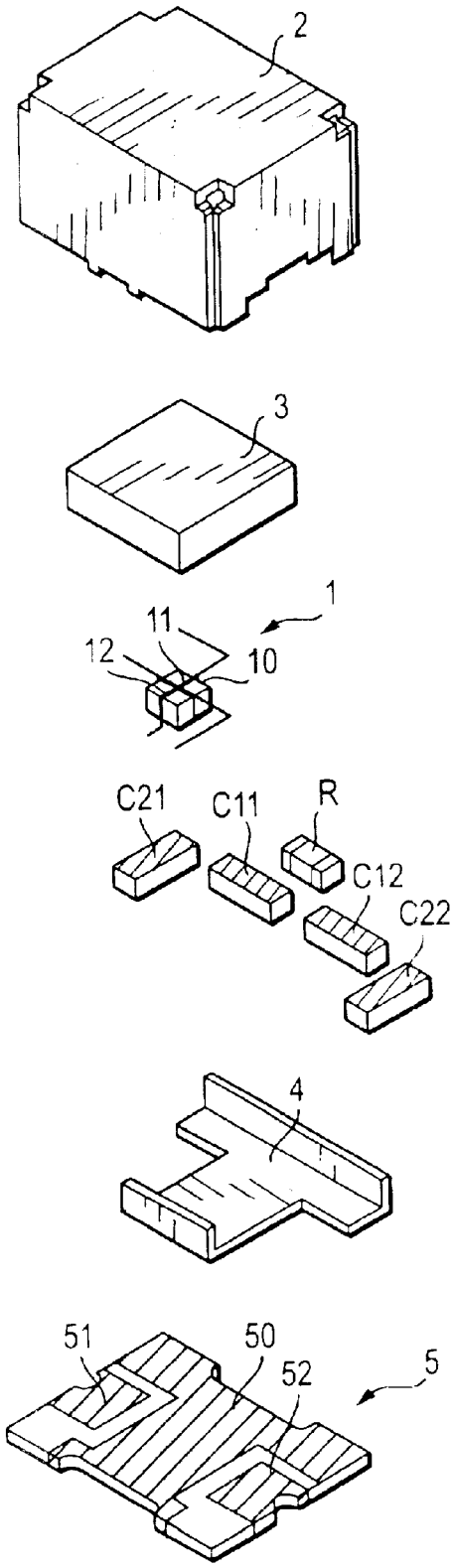
FIG. 2 is an exploded perspective view of the isolator.

FIG. 2 is an exploded perspective view of the isolator constituting the above circuit. Here, a ferrite assembly body 1 is formed by having the first center electrode 12 and the second center electrode 12 including insulator-coated copper wires each wrapped around the ferrite plate 10 by 1.5 turns. A magnet 8 applies the magnetostatic field to the ferrite plate 10. An upper yoke 2 and a lower yoke 4 constitute a part of the magnetic circuit. A substrate 5 has a ground electrode 50, an input terminal electrode 51, and an output terminal electrode 52 formed on the top face thereof. Some of these electrodes extend over the end faces of the substrate 5 to a part of the bottom face thereof. They are used as terminal electrodes when this isolator is surface-mounted on the circuit board of an electronic apparatus. C11, C12, C21, C22, and R are chip components that constitute the capacitors and the resistor of the individual components shown in FIG. 1. Among them, C11, C12, and R are mounted in the lower yoke 4 while C21 and C22 are mounted on the top face of the substrate 5.

Figure 3:
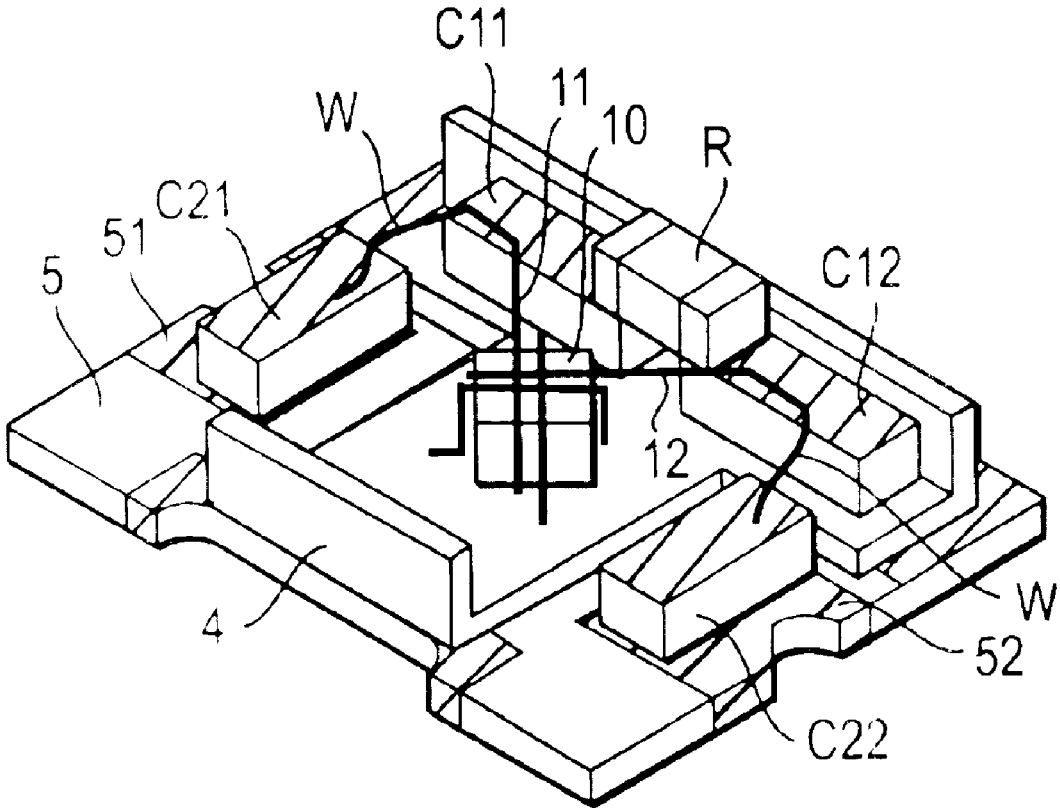
FIG. 3 is a perspective view of the isolator after main components of the isolator are assembled.

FIG. 3 is a perspective view illustrating a state in which each component shown in FIG. 2 is assembled and in which the upper yoke 2 and the magnet 3 are removed from the assembly. As shown in the figure, the lower yoke 4 is joined to the ground electrode 50 formed on the top face of the substrate 5 by means of soldering or the like, and the capacitors C11 and C12 and the ferrite assembly body 1 are joined to the top face of the lower yoke 4 by means of soldering or the like. The capacitors C11 and C12 are chip capacitors obtained by providing electrodes on the top and bottom faces thereof. The electrodes on the bottom faces thereof are soldered to the top face of the lower yoke 4. One end of each of the center electrodes 11 and 12 of the ferrite assembly body 1 is electrically connected to the top face of the lower yoke 4 by means of soldering. In addition, the other ends of the center electrodes 11 and 12 are soldered to the corresponding electrodes of the top faces of the capacitors C11 and C12. Furthermore, the electrodes of the two ends of the resistor R are soldered to the corresponding electrodes of the top faces of the capacitors C11 and C12. Since the wrapped parts of the center electrodes 11 and 12 around the ferrite plate 10 are coated with an insulator, electrical insulation between the center electrodes and between the center electrodes and the lower yoke 4 is each established.

Electrodes are provided on the top and bottom faces of the capacitors C21 and C22. The electrodes on the bottom faces are soldered to the corresponding input terminal electrode 51 and the output terminal electrode 52 of the substrate 5. The electrodes on the top faces of C21 and C22 are soldered via wires W to the corresponding electrodes on the top faces of C11 and C12.

The magnet 3 shown in FIG. 2 is attached to the ceiling face of the upper yoke 2. The upper yoke 2 to which this magnet 3 is attached covers the lower yoke 4, forming a closed magnetic circuit.

The dimensions of the ferrite plate 10 shown in FIGS. 1 and 2 are 0.5 mm×0.5 mm×0.3 mm. The thickness of the substrate 5 is 0.1 mm, the thickness of the lower yoke 4 is 0.15 mm, the thickness of the upper yoke 2 is 0.15 mm, and the diameters of the center electrodes 11 and 12 are 0.05 mm.

In a communication apparatus used in a mobile communication system such a portable phone, the market demands that the height dimension of the isolator be reduced to 1.5 mm or below in order to substantially decrease the occupied area (volume) of the isolator in the apparatus. Therefore, the height dimension is held at 1.5 mm or below due to the above construction and the dimensions of each component. When the dimensions of the each component other than the above ferrite plate are maintained and the ferrite plate 10 becomes thicker, and total height of the isolator can be maintained at 1.5 mm as long as the thickness of the ferrite plate is within 1 mm. Accordingly, in order to increase the dimensions of the ferrite plate as much as possible in the limited volume, the ferrite plate should be a rectangular parallelepiped in which the dimension of each side thereof is 1 mm or below.

Figure 4A:
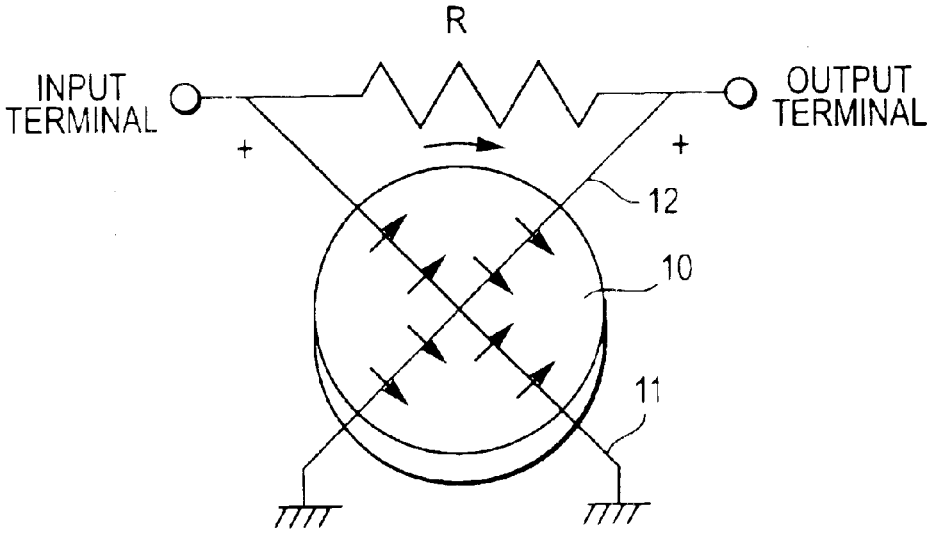
FIGS. 4A and 4B are circuit diagrams illustrating the operating principle of the isolator.

FIGS. 4A and 4D are circuit diagrams illustrating the operation principle of the above isolator.

Figure 4B:
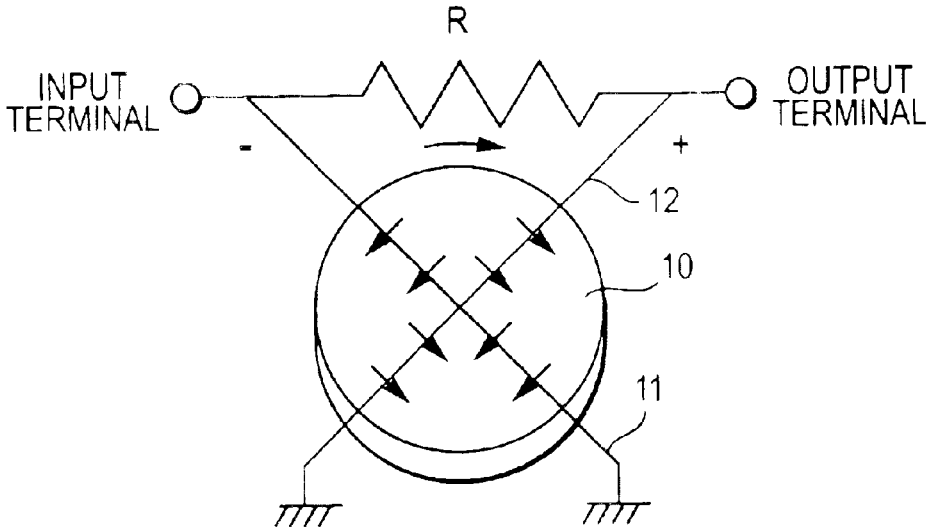

In FIGS. 4A and 4B, arrows indicate the directions of the high-frequency magnetic field under the influence of the center electrodes 11 and 12. Considering the transmission of a forward signal, since the phases and the amplitudes at both ends of the resistor R are equal, as shown in FIG. 4A, no current flows through the resistor R, allowing an input signal from the input terminal to be simply output from the output terminal.

Considering the reflection of a reverse signal, as shown in FIG. 4B, the direction of the high-frequency magnetic field passing through the ferrite plate 10 is opposite to that in the case in FIG. 4A. Thereafter, an opposite phase signal is generated between both ends of the resistor R and the power thereof is dissipated in the resistor R. Accordingly, ideally, no signal is output from the input terminal. When the above resistor R is removed from the circuit, the circuit acts as a gyrator.

In fact, when the signal is transmitted in the forward direction and when the signal is incident in the reverse direction, there is a change in the phase different between both ends of the resistor in accordance with the intersection angle of the center electrodes 11 and 12 and the rotation angle of the plane of polarization due to Faraday rotation. Therefore, the intensity of the external magnetic field and the intersection angle of the center electrodes 11 and 12 are set so that low insertion loss and high nonreciprocal characteristic (an isolation characteristic) can be obtained. The intensity of the magnetic field applied to the ferrite plate is normally in the range of 0.09 to 0.17 T and the rotation angle of the plane of polarization due to Faraday rotation is normally in the range of 90 degrees to 100 degrees. Accordingly, when the intersection angle of the center electrodes 4*a* and 4*b* is within the range of 80 degrees to 100 degrees, low insertion loss and high nonreciprocal characteristic (the isolation characteristic) can be obtained.

Matching the input/output impedances and the impedance of the isolator is a prerequisite for the above action. However, when the ferrite plate is greatly miniaturized to, for example, 0.5 mm×0.5 mm×0.3 mm while the conventional construction is maintained, the length of the center electrode is shortened, which, as described above, decreases the inductance component of the center electrode. Accordingly, impedance matching cannot be obtained when operating at a desired frequency.

Therefore, as shown in FIGS. 1 and 2, the center electrodes 11 and 12 are wrapped around the ferrite plate 10. This greatly increases the inductance of the center electrode with even the small ferrite plate, realizing a widened operation frequency band. However, because of the large increase in the inductance due to wrapping of the center electrodes, use of only the matching parallel capacitors sometimes cause the impedance to be greater than the normalized impedance (50 Ω), which results in mismatching. Accordingly, as shown in FIGS. 1 and 2, the series capacitors are connected in series with the input/output terminals.

Figure 5A:
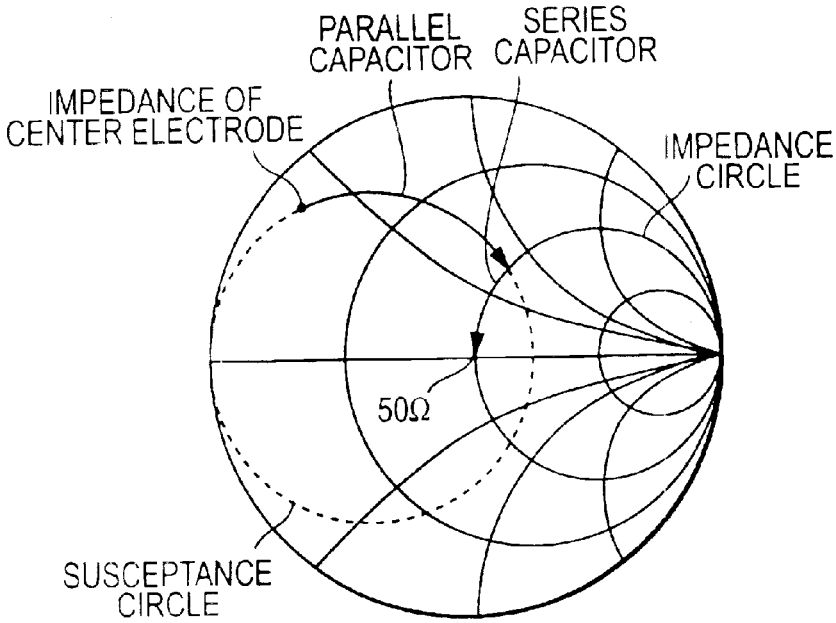
FIGS. 5A and 5D are diagrams illustrating examples of impedance matching of the isolator.
Figure 5B:
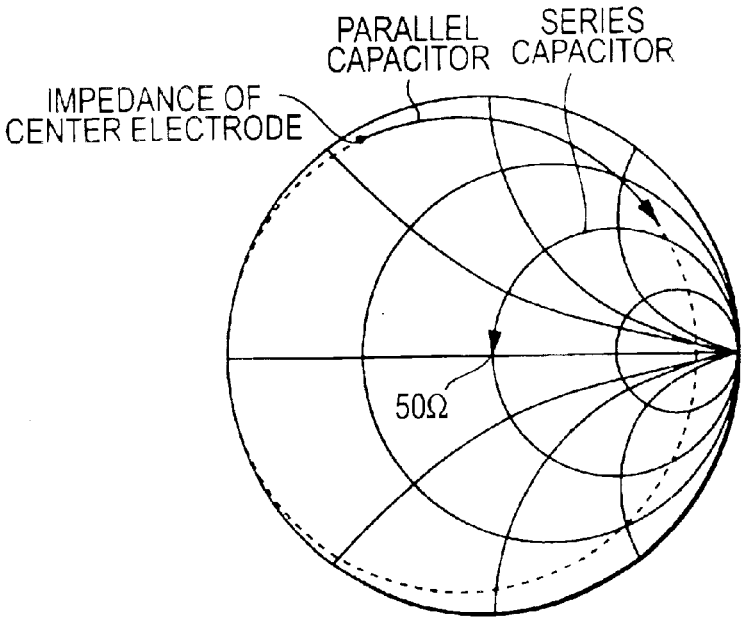

FIGS. 5A and 5B are diagrams illustrating examples of impedance matching between the parallel capacitors and the series capacitors. FIG. 5A represents an example of a case in which the inductance of the center electrode is relatively low and FIG. 5B represents an example of a case in which the inductance of the center electrode is relatively high. In either case, the combined impedance moves along the susceptance circle by the connection of the parallel capacitor and then the combined impedance moves along the impedance circle by the connection of the series capacitor, whereby the values of the parallel capacitor and the series capacitor are set so that the combined impedance ultimately matches the normalized impedance (50 Ω).

Thus, in a two-port isolator making use of the gyrator having two center electrodes, there is a case in which the intensity of the magnetostatic field applied to the ferrite field is frequently changed in order to optimize the phase rotation angle of the gyrator. This changes the magnetic permeability of the ferrite, which also changes the inductance of the center electrodes. Even in this case, impedance matching can be easily obtained without changing the shape and the like of the center electrode but by changing the capacitances of the parallel capacitor and the series capacitor. Accordingly, this facilitates design or adjustment for the above optimization.

In the impedance matching circuit having two kinds of capacitor which are the parallel capacitors and the series capacitors, compared to a case in which the impedance matching circuit uses only a kind of a parallel capacitor, the capacitance of the capacitors can be greatly decreased and, when a single plate capacitor is used, the size thereof can be decreased. For example, when the inductance of the center electrodes wrapped around the ferrite plate is 19.8 nH, the capacitance of the parallel capacitors is 0.5 to 1.5 pF, and the capacitance of the series capacitors is 0.5 to 2.2 pF. The dimension of the capacitor is a thickness of 0.17 mm, a width of 0.45 mm, a length of 0.85 mm or below when a dielectric material of a relative dielectric constant of 110 is used. Therefore, the isolator having dimensions of 3.5 mm square or below can be achieved when the ferrite plate having dimensions of 1 mm square or below is used.

The above series capacitors or parallel capacitors may be constructed using a chip capacitor having a laminated structure obtained by alternately laminating electrode layers and dielectric layers. In this case, since the chip capacitor is further miniaturized, even when the center electrodes are wrapped around a ferrimagnetic body and the inductance of the center electrode is excessively increased, impedance matching can be easily obtained by setting the capacitance of the series capacitors or the parallel capacitors to be greater, which facilitates further miniaturization of the overall nonreciprocal circuit device.

Figure 6A:
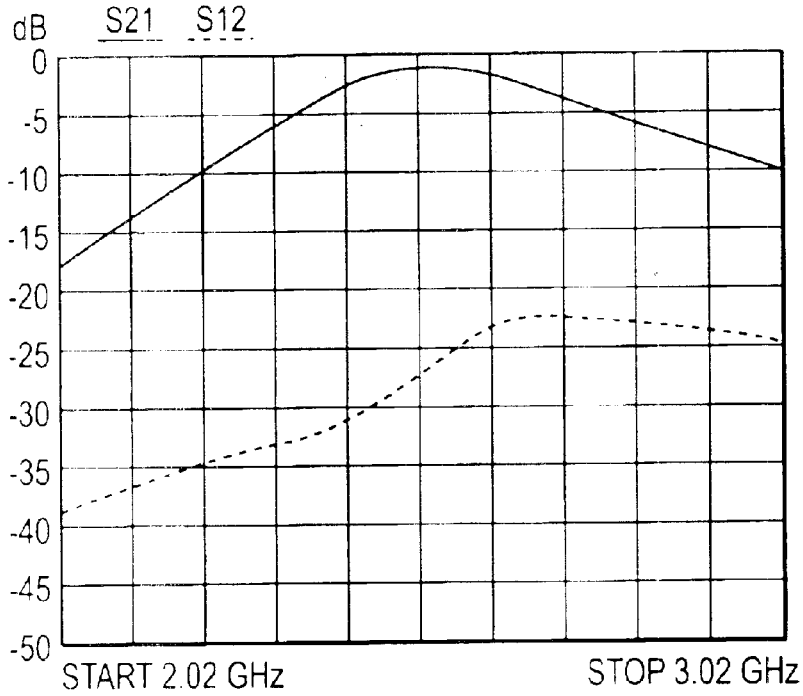
FIGS. 6A and 6B are diagrams illustrating examples of frequency characteristics of the isolator.
Figure 6B:
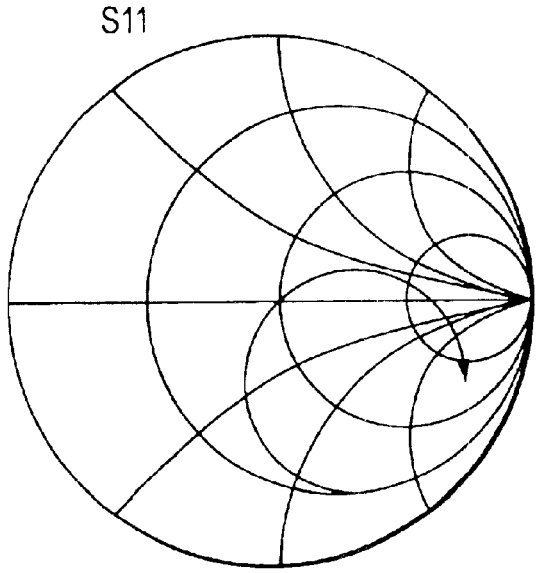

FIGS. 6A and 6B are diagrams illustrating frequency characteristics of the insertion loss and the input impedance of the above isolator in which the center frequency is designed to be 2.52 GHz. FIG. 6A represents losses of a transmission characteristic S21 and a reflection characteristic S12 when the frequency is changed from 2.02 GHz to 3.02 GHz. FIG. 6B represents the locus of the input impedance in accordance with the frequency change. Thus, since the input/output impedances match the normalized impedance (50 Ω), a low insertion loss characteristic is exhibited.

In the conventional isolator which is formed so as to obtain matching using only the parallel capacitors, when the inductance is excessively increased due to the manner in which the center electrodes are wrapped around the ferrite plate, since the high input impedance leads to mismatching as described below, the insertion loss is deteriorated.

Figure 10A:
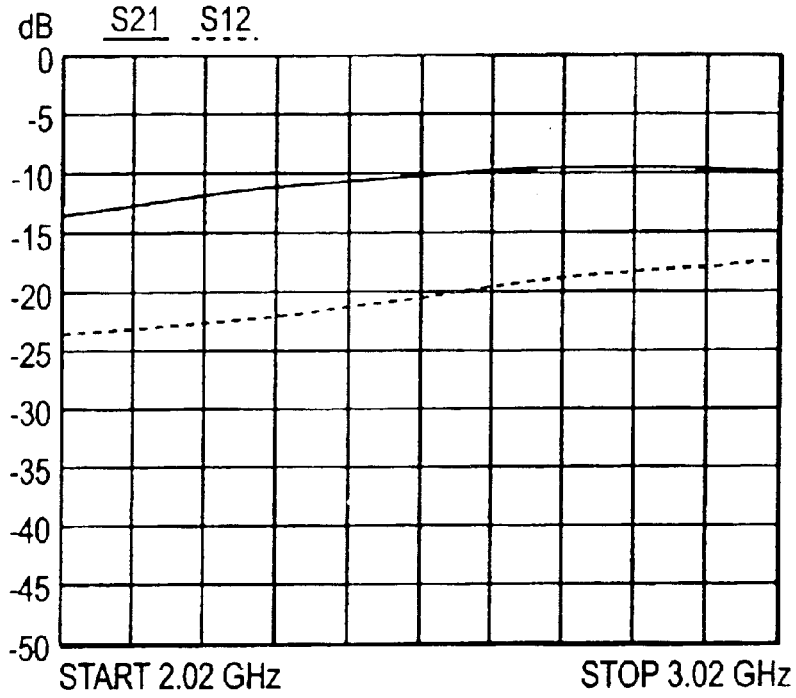
FIG. 10A PRIOR ART
FIGS. 10A and 10B are diagrams illustrating examples of frequency characteristics in an impedance mismatching state of the isolator having the conventional construction.
Figure 10B:
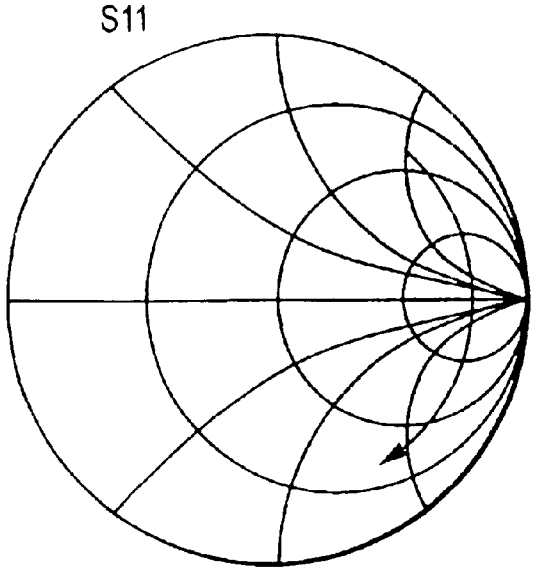
PRIOR ART FIG. 10B

FIGS. 10A and 10B are diagrams illustrating frequency characteristics of the insertion loss and the input impedance of the above isolator. In the same manner as in FIGS. 6A and 6B, 2.52 GHz is designed as the center frequency. FIG. 10A represents losses of the transmission characteristic S21 and the reflection characteristic S12 when the frequency is changed from 2.02 GHz to 3.02 GHz. FIG. 10B represents the locus of the input impedance in accordance with the frequency change. As shown in figures, when the inductance of the center electrode is excessively increased, the input/output impedance increases and the insertion loss becomes worse at approximately −10 dB.

On the other hand, as shown in FIGS. 5A and 5B, impedance matching using the parallel capacitor and the series capacitor enables the insertion loss to be improved to approximately −1.6 dB in the example of FIGS. 6A and 6B.

Next, the construction of a high-frequency circuit apparatus, such as the communication apparatus or a signal measuring circuit, is described with reference to FIGS. 7A and 7B.

Figure 7A:
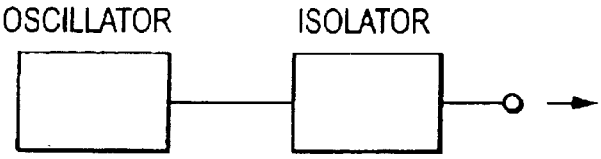
FIGS. 7A and 7B are block diagrams showing main components of a high-frequency circuit apparatus according to a second embodiment.

Using the above-described various types of isolators, for example, as shown in FIG. 7A, the isolator is provided in an oscillation output unit of an oscillator such as a VCC (Voltage Controlled Oscillator), so that a reflected wave from a transmission circuit connected to the output unit of the isolator is not incident on the oscillator. This increases the oscillation stability of the oscillator.

Figure 7B:
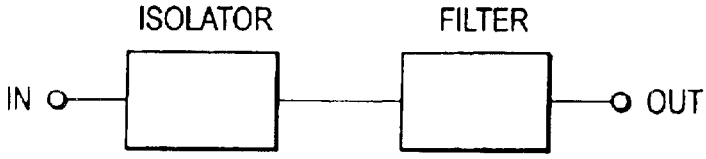
Figure 8:
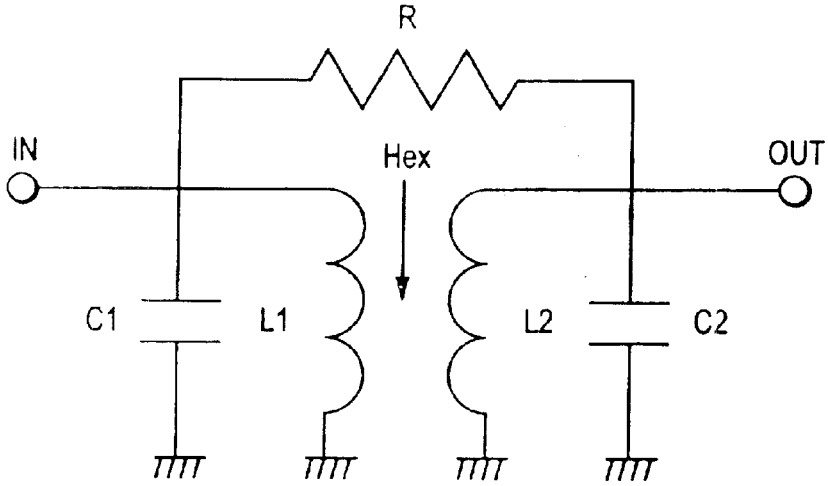
FIG. 8 PRIOR ART
FIG. 8 is a circuit diagram of a conventional isolator.
Figure 9:
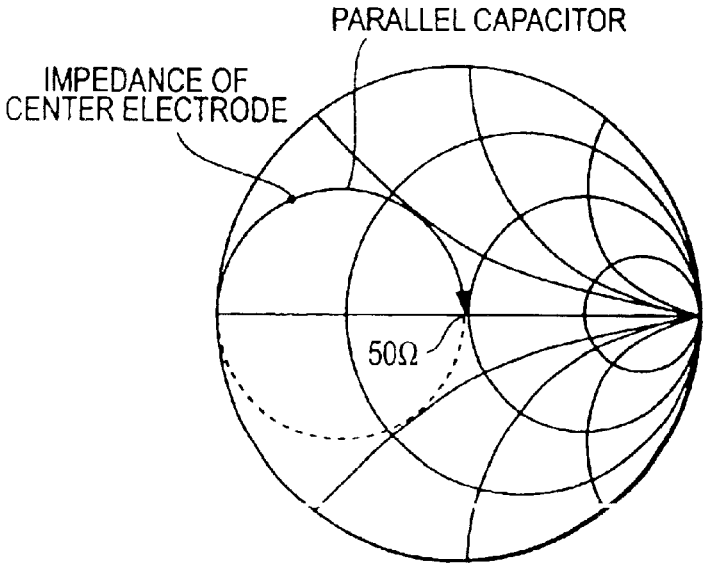
FIG. 9 PRIOR ART
FIG. 9 is a diagram illustrating an example of impedance matching of the conventional isolator.

As shown in FIG. 7B, the isolator is provided in an input unit of a filter, whereby the isolator is used for matching. This constitutes a constant impedance filter. The communication apparatus is constructed by providing such a circuit in a transmission/reception circuit unit.

In each of the above-described embodiments, the isolator is used. However, when the gyrator (a nonreciprocal phase device) exhibiting a characteristic in which phase delays are different according to the transmission direction between the two ports of the gyrator is constructed, the resistor R shown in the embodiments may be omitted.

In the above-described embodiments, although the linear center electrode is wrapped around the ferrite plate, a sheet material forming a center electrode pattern may be provided so as to be laminated on the ferrite plate or so as to be held between the two ferrite plates.

What is claimed is:

1. A nonreciprocal circuit device comprising:

a first wire center electrode and a second wire center electrode intersecting each other, each having a first end thereof grounded, and no other center lectrodes;

a ferrimagnetic body provided in the vicinity of said first center electrode and said second center electrode, said first and second center electrodes being wrapped around said ferrimagnetic body;

a magnet applying a magnetostatic field to said ferrimagnetic body;

a series capacitor connected in series between a second end of said first center electrode and an input terminal and a series capacitor connected in series between a second end of said second center electrode and an output terminal and no series inductor connected in series between the second end of said first center electrode and the input terminal nor in series between the second end of said second center electrode and the output terminal; and a parallel capacitor connected in parallel between the second end of said first center electrode and a ground and a parallel capacitor connected in parallel between the second end of said second center electrode and the ground.

2. A nonreciprocal circuit device according to claim 1, wherein said ferrimagnetic body has a substantially rectangular parallelpiped shape and a dimension of each side of said ferrimagnetic body is about 1 mm or less, and a maximum height of the nonreciprocal circuit device is about 1.5 mm or less.

3. A nonreciprocal circuit device according to claim 1, wherein the intersection angle of said first center electrode and said second center electrode is a predetermined angle in the range of 80 degrees to 100 degrees.

4. A nonreciprocal circuit device according to claim 1, wherein said ferrimagnetic body is a polygonal plate.

5. A nonreciprocal circuit device according to claim 1, wherein said magnet is a rectangular parallelepiped.

6. A nonreciprocal circuit device according to claim 1, wherein said first center electrode, said second center electrode, said ferrimagnetic body, and said magnet are provided between an upper yoke and a lower yoke; and said upper yoke and said lower yoke are grounded.

7. A nonreciprocal circuit device according to claim 1, wherein a capacitance of the series capacitors is in the range of about 0.5 to about 2.2 pF and a capacitance of the parallel capacitors is in the range of about 0.5 to about 1.5 pF, and a maximum height of the nonreciprocal circuit device is about 1.5 mm or less.

8. A nonreciprocal circuit device according to claim 1, wherein the intersection angle of said first center electrode and said second center electrode is a predetermined angle in the range of 80 degrees to 100 degrees.

9. A nonreciprocal circuit device according to claim 1, wherein diameters of said first center electrode and said second center electrode are 0.05 mm.

10. A nonreciprocal circuit device according to claim 1, wherein said wire center electrodes are coated with insulating coating, and a maximum height of the nonreciprocal circuit device is about 1.5 mm or less.

11. A high-frequency circuit apparatus comprising a nonreciprocal circuit device according to claim 1.

12. A high-frequency circuit apparatus comprising a nonreciprocal circuit device according to claim 11, further comprising an oscillator connected to said nonreciprocal circuit device.

13. A high-frequency circuit apparatus comprising a nonreciprocal circuit device according to claim 11, further comprising a filter connected to said nonreciprocal circuit device.

14. A high-frequency circuit apparatus comprising a nonreciprocal circuit device according to claim 11, wherein said high-frequency circuit apparatus comprises one of a communication circuit and a signal measuring circuit.

15. A nonreciprocal circuit device comprising:

a first wire center electrode and a second wire center electrode intersecting each other, each having a first end thereof grounded, and no other center electrodes;

a ferrimagnetic body provided in the vicinity of said first center electrode and said second center electrode, said first and second center electrodes being wrapped around said ferrimagnetic body;

a magnet applying a magnetostatic field to said ferrimagnetic body;

a series capacitor connected in series between a second end of said first center electrode and an input terminal and a series capacitor connected in series between a second end of said second center electrode and an output terminal; and a parallel capacitor connected in parallel between the second end of said first center electrode and a ground and a parallel capacitor connected in parallel between the second end of said second center electrode and the ground; and a resistor connected to a top surface of the parallel capacitor connected in parallel between the second end of said first center electrode and the ground and to a top surface of the parallel capacitor connected in parallel between the second end of said second center electrode and the ground such that the resistor extends between the series capacitor connected in series between the second end of said first center electrode and the input terminal and the series capacitor connected in series between the second end of said second center electrode and the output terminal.

16. A nonreciprocal circuit device according to claim 15, wherein said ferrimagnetic body has a substantially rectangular parallelpiped shape and a dimension of each side of said ferrimagnetic body is about 1 mm or less, and a maximum height of the nonreciprocal circuit device is about 1.5 mm or less.

17. A nonreciprocal circuit device according to claim 15, wherein the intersection angle of said first center electrode and said second center electrode is a predetermined angle in the range of 80 degrees to 100 degrees.

18. A nonreciprocal circuit device according to claim 15, wherein said ferrimagnetic body is a polygonal plate.

19. A nonreciprocal circuit device according to claim 15, wherein said magnet is a rectangular parallelepiped.

20. A nonreciprocal circuit device according to claim 15, wherein said first center electrode, said second center electrode, said ferrimagnetic body, and said magnet are provided between an upper yoke and a lower yoke; and said upper yoke and said lower yoke are grounded.

21. A nonreciprocal circuit device according to claim 15, wherein the intersection angle of said first center electrode and said second center electrode is a predetermined angle in the range of 80 degrees to 100 degrees.

22. A nonreciprocal circuit device according to claim 15, wherein diameters of said first center electrode and said second center electrode are 0.05 mm.

23. A nonreciprocal circuit device according to claim 15, wherein said wire center electrodes are coated with insulating coating, and a maximum height of the nonreciprocal circuit device is about 1.5 mm or less.

24. A nonreciprocal circuit device according to claim 15, wherein a capacitance of the series capacitors is in the range of about 0.5 to about 2.2 pF and a capacitance of the parallel capacitors is in the range of about 0.5 to about 1.5 pF, and a maximum height of the nonreciprocal circuit device is about 1.5 mm or less.

25. A high-frequency circuit apparatus comprising a nonreciprocal circuit device according to claim 15.

26. A high-frequency circuit apparatus comprising a nonreciprocal circuit device according to claim 25, further comprising an oscillator connected to said nonreciprocal circuit device.

27. A high-frequency circuit apparatus comprising a nonreciprocal circuit device according to claim 25, further comprising a filter connected to said nonreciprocal circuit device.

28. A high-frequency circuit apparatus comprising a nonreciprocal circuit device according to claim 25, wherein said high-frequency circuit apparatus comprises one of a communication circuit and a signal measuring circuit.

* * * * *